United States Patent [19]

Hines et al.

[11] Patent Number: 4,748,450

[45] Date of Patent: May 31, 1988

[54] VEHICULAR MULTIBAND ANTENNA FEEDLINE COUPLING DEVICE

[75] Inventors: John N. Hines, Morristown; Robert E. Myer, Denville, both of N.J.

[73] Assignee: American Telephone and Telegraph Company, AT&T Bell Laboratories, Murray Hill, N.J.

[21] Appl. No.: 881,761

[22] Filed: Jul. 3, 1986

[51] Int. Cl.[4] ..... H01Q 1/32

[52] U.S. Cl. ..... 343/820; 343/715; 343/791; 343/883; 343/901; 343/822

[58] Field of Search ..... 343/715, 729, 791, 793, 343/820, 831, 883, 822, 901

[56] References Cited

U.S. PATENT DOCUMENTS

| | | | |
|---|---|---|---|
| 3,945,013 | 3/1976 | Brunner et al. | 343/708 |
| 4,037,177 | 7/1977 | Tyrey | 333/32 |
| 4,058,811 | 11/1977 | Gauss et al. | 343/715 |
| 4,084,163 | 4/1978 | Maynard | 343/715 |
| 4,095,229 | 6/1978 | Elliott | 343/715 |
| 4,217,589 | 8/1980 | Stahler | 343/722 |
| 4,228,544 | 10/1980 | Guyton | 455/282 |
| 4,513,338 | 4/1985 | Goodall et al. | 343/904 |
| 4,571,595 | 2/1986 | Phillips et al. | 343/745 |
| 4,590,614 | 5/1986 | Erzt | 343/793 |
| 4,647,941 | 3/1987 | Myer | 343/792 |
| 4,658,260 | 4/1987 | Myer | 343/792 |

*Primary Examiner*—William L. Sikes
*Assistant Examiner*—Doris J. Johnson
*Attorney, Agent, or Firm*—Jack S. Cubert; Charles S. Phelan

[57] ABSTRACT

A multiband antenna mounting and feedline coupling arrangement includes a first transmission line segment secured in a mounting device for the antenna for coupling energy to and from the antenna. A second transmission line segment, extending, e.g., to grounded high band equipment, provides high band signal coupling with the first line and includes a direct current blocking capacitor in series in the ground return path of that second line segment, the capacitor having such a low impedance to high band energy that it presents negligible impedance to such energy. A third transmission line segment provides low band signal coupling with the first line by way of a part of the ground return path of the first line. A high band quarter wave, in the high band, filter stub transmission line is connected between the signal and ground return paths of the third transmission line adjacent to the point of coupling thereof to the first line. Several different implementations of the capacitor and transmission line segment combination are illustrated.

7 Claims, 5 Drawing Sheets

FIG. 10
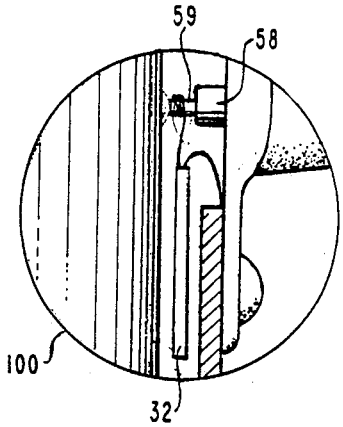
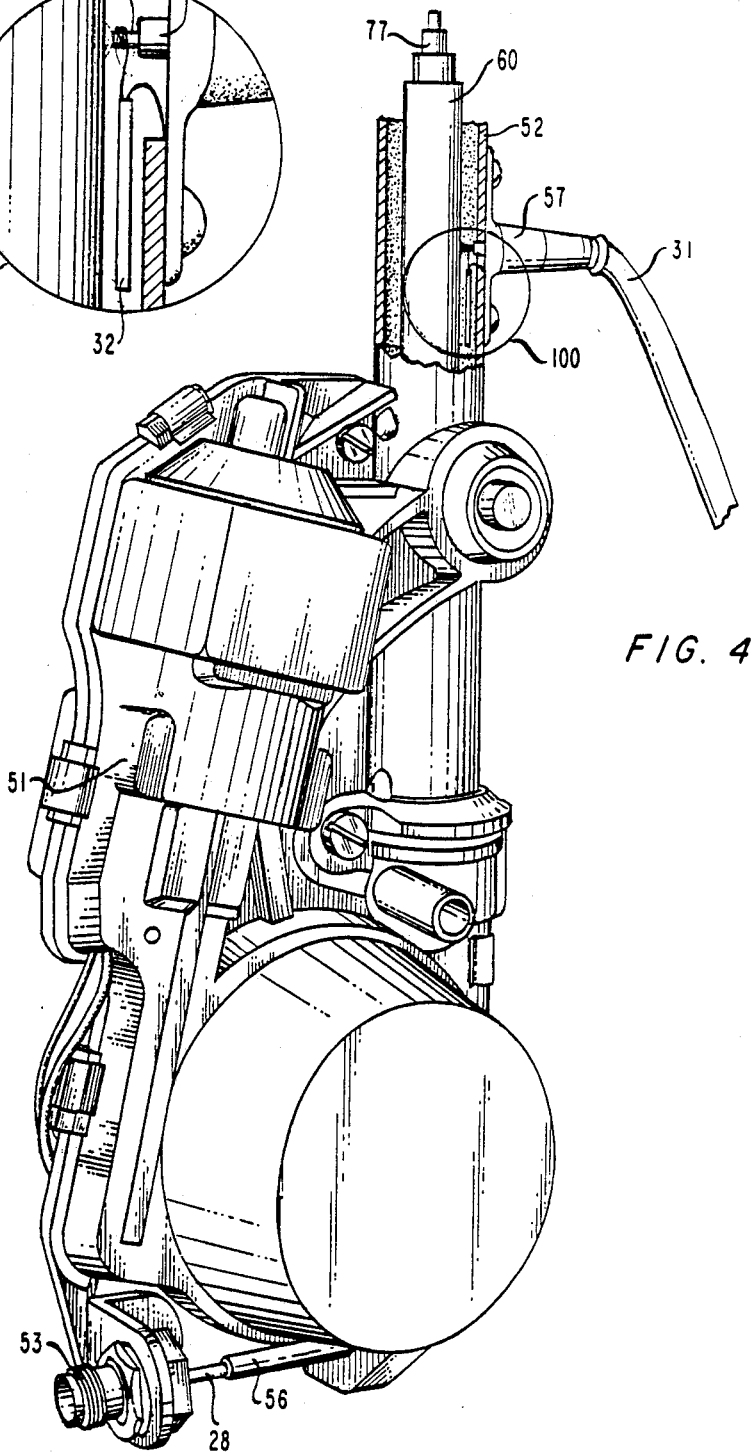
FIG. 4

VEHICULAR MULTIBAND ANTENNA FEEDLINE COUPLING DEVICE

FIELD OF THE INVENTION

This invention relates to feedline coupling arrangements for multiband antennas, and it relates more particularly to such antennas which are useful for vehicular mounting.

BACKGROUND OF THE INVENTION

It is well recognized in the automotive field that it is desirable to install radio reception equipment and radio transceiver equipment with a minimum of damage to the vehicle and with a minimum of disturbance of the aesthetic impression sought to be conveyed by the vehicle designers. To that end, multiband antennas have been utilized; and, in addition considerable effort has been expended to devise a multiband antenna that does not reveal to possible thieves the character of presently-unusual radio equipment in the vehicle.

The advent of citizens' band radio spawned arrangements in which band separation impedance networks, either near the radio equipment for the respective bands or adjacent to the antenna, were coupled through a common transmission line for all bands to a single antenna element, sometimes called a compromise antenna element, for all bands of interest. Some examples of such arrangements can be found in the U.S. Pat. Nos. 4,037,177 to E. A. Tyrey, 4,095,229 to J. O. Elliott, and 4,228,544 to J. H. Guyton.

A variety of techniques have been taught for coupling networks adjacent to the antenna. U.S. Pat. No. 4,571,595 to J. P. Phillips et al. employs in a path common to all bands a tuning capacitor connected to the antenna elements per se and a transmission line tuning stub connected to the antenna ground plane. A parallel resonant (at the lowest frequency), coaxial cable feed device is used with a triband trap vertical antenna having a coaxial-resonant end feed in U.S. Pat. No. 4,217,589 to A. F. Stahler. A. Brunner et al. show in U.S. Pat. No. 3,945,013 a double omnidirectional antenna provided with a triaxial band separation arrangement for a two-identification-frequency radar and in which the outer conductor of an inner coaxial line serves also as the inner conductor of an outer coaxial line. In Brunner et al., a shorted quarter-wave-low band transmission line section is incorporated into the triaxial structure to present a high impedance to a narrow frequency range of low band energy that might otherwise be diverted into the inner (high band) line outer conductor path to the high band radio equipment.

SUMMARY OF THE INVENTION

A feedline coupler for a multiband antenna has at least a high frequency band capability and a low frequency band capability includes a direct current blocking capacitor having negligible impedance in the high band. The capacitor is connected in series between the ground return paths of a transmission line segment used by both high band and low band signals and a transmission line segment for only high band signals. The capacitor presents a relatively high impedance to low band signals to prevent the low band signals from being short circuited to a ground on any high band equipment connected to the high band line. In one embodiment, the coupler includes a high band filter in a transmission line segment used for only low band signals. The filter presents a high impedance to high band signals to block them from the low band transmission line segment.

BRIEF DESCRIPTION OF THE DRAWING

A more complete understanding of the invention and its various features objects and advantages may be obtained from a consideration of the following Detailed Description in connection with the appended claims and the attached Drawings in which

FIG. 4 is a perspective view of another coaxial cable embodiment of a coupler arrangement of the type illustrated in FIG. 1 incorporated into a power driven telescopically extendable and retractable, antenna housing;

FIG. 10 is an enlarged view of a portion of FIG. 4 showing the connections between the antenna feedline and the low band transmission line in greater detail.

DETAILED DESCRIPTION

Figure 1:
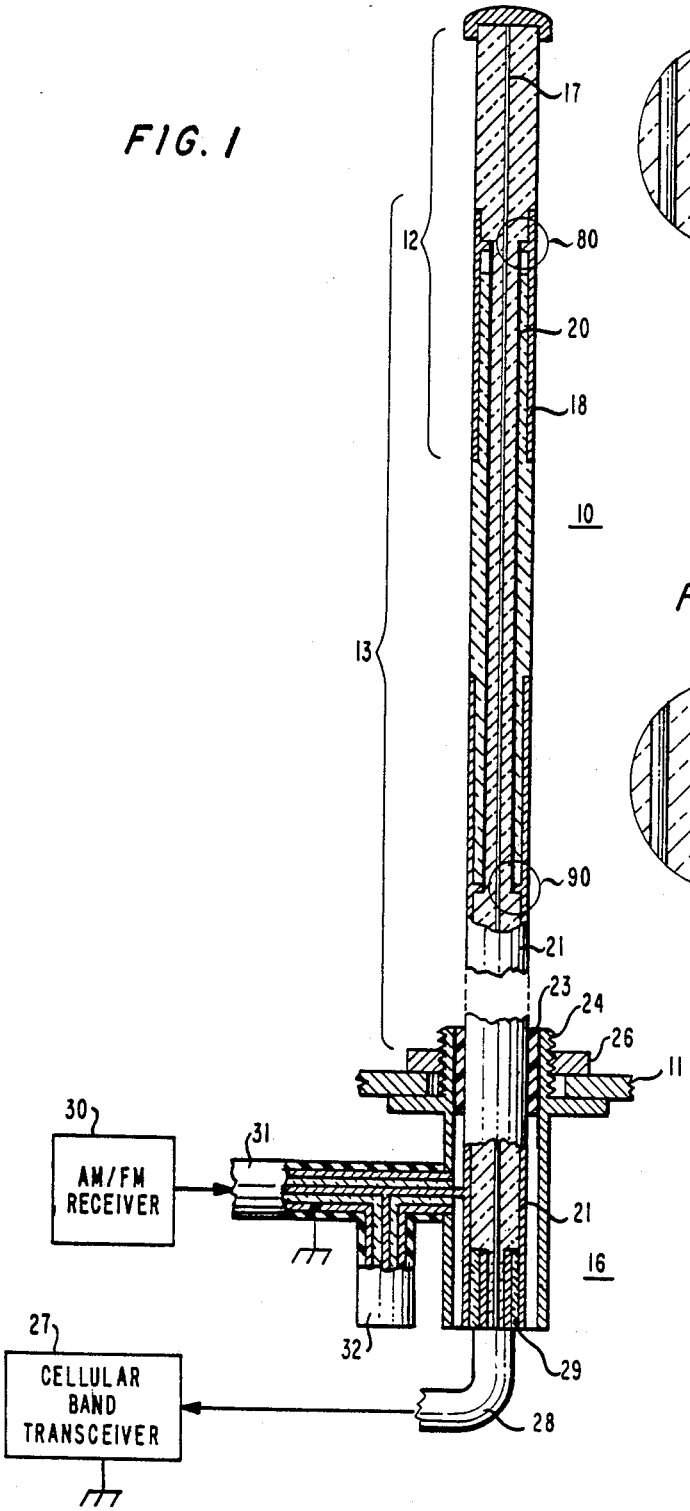
FIG. 1 is a diagram, partially in schematic form, of a multiband antenna system with a feed line coupler in accordance with the present invention.

In FIG. 1, a multiband antenna 10 of the type shown in U.S. Pat. No. 4,647,941 issued to R. E. Myer on Mar. 3, 1987 and entitled "Telescopic Antenna", is mounted through a body panel 11, which serves as a ground plane, of a vehicle (not otherwise shown). The antenna includes a high frequency band element 12 and an overlapping low frequency band element 13 above the panel 11 and a feed line coupler 16 below the panel. A center frequency of the high band is advantageously approximately an order of magnitude larger than a center frequency of the low band. Illustratively the low band is herein considered to be the AM/FM broadcast reception band with, e.g., an FM band center frequency of approximately 98 megahertz; and the high band is the cellular radiotelephone band with a center frequency of approximately 850 megahertz.

Figure 8:
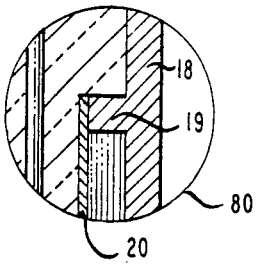
FIG. 8 is an enlarged view of a portion of the high frequency band antenna element of FIG. 1 showing a section thereof in greater detail.
Figure 9:
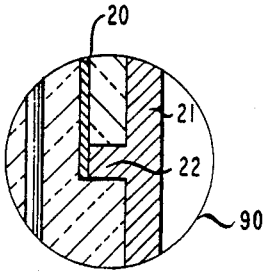
FIG. 9 is an enlarged view of a portion of the low frequency band antenna element of FIG. 1 showing a section thereof in greater detail.

For the convenience of the reader, the antenna 10 structure is here briefly outlined to the extent useful to illustrate application of coupler 16. The element 12 is advantageously a center-fed dipole comprising an upper quarter-wave (high band) length of a center conductor 17 and a quarter-wave length of a conductive sleeve, or skirt, 18. As shown in the enlarged view of FIG. 8 indicated by circle 80, sleeve 18 is connected by a conductive ring 19 around its interior to a shield, i.e. ground return path, 20 which comprises with conductor 17 a coaxial feed line for dipole antenna element 12. The portion of that same sleeve 18 above ring 19 cooperates with the ring 19 and the shield 20 to comprise an upper part of the low band antenna 13. That upper part is electrically connected to a tube 21 by way of a further ring 22 on the interior of tube 21 as sown in the enlarged view of FIG. 9 indicated by circle 90. The portion of tube 21 above ring 22 is a coaxial choke, and the exterior portion of tube 21 below ring 22 is a lower portion of the low band, rod-type, antenna element 13. At panel 11, tube 21 passes through the panel via a collar 23 of insulating material. Collar 23 is inside of a threaded, electrically conductive collar 24 which has a lateral extension below the panel that forms a flange; and a nut 26 is tightened down on the collar 24 to secure the panel between the nut and the flange extension. Tube 21 is secured in the collar 23 by any suitable means, such as bonding. Collar 23 is secured to collar 24 in a similar manner.

A high band transceiver, such as the cellular radiotelephone band transceiver 27, is bidirectionally coupled through a coaxial transmission line 28 to the conductor 17 and the lower end of tube 21 in the coupler 16. Transceiver 27 is grounded to vehicle ground. The center conductor signal path of transmission line 28 comprises a continuous direct current path with the conductor 17. The ground return path, or shield, of transmission line 28 is connected to vehicle ground at the transceiver 27 and is capacitively coupled to the lower end of tube 21 by means of a direct current blocking capacitor in series between the tube 21 and the shield of line 28. That capacitor is formed by a dielectric material cylinder 29 interposed between telescoped ends of the shield of line 28 (its insulating jacket being stripped away) and the lower end of tube 21. The capacitance of that blocking capacitor is a function of the length and dielectric constant of dielectric cylinder 29 and the relative outside diameter of the shield on line 28 and inside diameter of tube 21. The capacitance is advantageously made to have an impedance at the center of the high band which is much lower than the impedance at the center of the low band. In the illustrative embodiment considered here, a capacitance of about 15 picofarads works well. Thus, the capacitor is essentially transparent to high band signals but still comprises a block to prevent low band signals from the antenna from being shorted to the vehicle ground at transceiver 27.

A low band radio receiver, such as the AM/FM receiver 30, is coupled through a coaxial transmission line 31 to the lower end of tube 21 in coupler 16. The center conductor signal path of transmission line 31 electrically engages the lower portion of tube 21 and comprises with it a continuous direct current feed line to the low band antenna 13. Thus, the portion of tube 21 above panel 11 comprises both part of a coaxial feed line for high band antenna element 12 and part of the energy intercepting portion of low band antenna element 13. The portion of tube 21 below panel 11, i.e. in coupler 16, is part of the low band, feed line, signal path and part of the high band, feed line, ground return path. Line 31 has its ground return path connected to vehicle ground at a point adjacent to the line signal path connection to tube 21 in coupler 16. This ground connection advantageously is accomplished where the line 31 meets collar 24, and it is further schematically represented by the nearby ground symbol on line 31. Otherwise, the shield of line 31 is not directly electrically connected to the shield of line 28, thereby eliminating one possibility for sneak paths for ground currents from other appliances in the same vehicle to get into the feedline for the high band antenna 12.

AM/FM receiver input stage filters are usually not sufficiently selective to block out all cellular band energy. Since cellular band transmitter output power is at a much higher level than any received energy, there is a possibility that in some circumstances sufficient cellular band transmitter energy may get through the input filter in receiver 30 to overload or damage receiver components. For that circumstance extra assurance of freedom of the low band receiver input from high band transmitted signals is provided by a quarter-wave, at the center of the high band, open circuited, transmission line, stub filter 32 connected between signal path and ground return path of the line 31 adjacent to the point of connection of line 31 signal path to tube 21 and adjacent to the vehicle ground connection of the line 31 shield to collar 24.

Summarizing, the capacitor represented by the telescoped ends of the coaxial rod including tube 21 and the shield of coaxial transmission line 28 is a low impedance of substantially no attenuation effect upon high band signals. That capacitor provides no effective ground return path through line 28 for low band signals which see in the capacitor a much higher impedance to ground than that through the central conductor of transmission line 31 and input circuits of receiver 30. Thus, low band signals from the antenna are substantially entirely coupled to receiver 30 by way of transmission line 31. The stub filter 32 has no significant shunting effect on low band signals, but it does appear as a short circuit to ground across the input to line 31 for high band signals which may be on the outside of ground return conductor tube 21. Consequently, such signals do not reach the input to receiver 30. Those high band signals pass between coupler 16 and high band antenna 12 without significant radiation from the coaxial feed line comprising conductor 17 and tube 20 and 21. No complex band separation impedance network is required.

In those applications utilizing a stub filter 32, the stub is a quarter-wave section in the high band and so is, e.g., for the cellular radiotelephone band around 850 megahertz, only about three inches long. The stub filter can be conveniently incorporated into the coupling/mounting structure for the antenna, as will be further described below. The stub filter need be effective over a bandwidth of only about 20 MHz to span the potentially damaging transmitter part of the cellular band.

Figure 2:
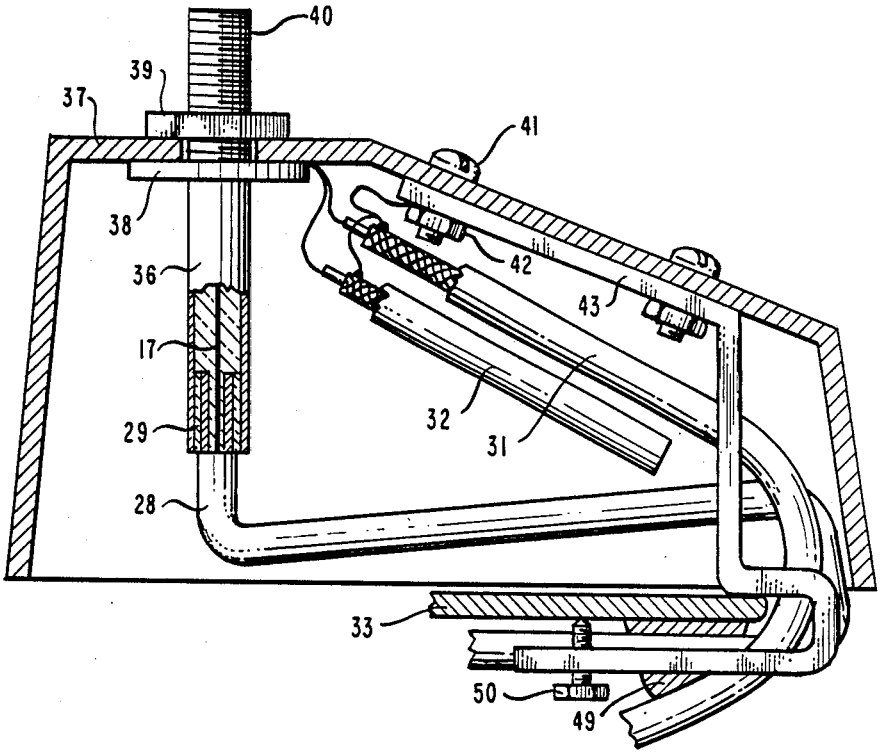
FIG. 2 is a side view of a coaxial cable embodiment of a coupler and enclosure therefore, partly in section, for mounting on, e.g., an edge of a vehicle trunk lid.

In FIG. 2 there is shown a side elevation view, partly in section, of the band separation, feed line coupler 16 of FIG. 1 incorporated into a device for mounting a multiband whip antenna on, instead of through, a suitable panel, e.g., a trunk lid 33, of a vehicle. In this embodiment, a tube 36 of conductive material extends through the top of a housing 37 of insulating material. Housing 37 is shown with the near side wall removed to make interior arrangements visible. Tube 36 corresponds to the lower portion of tube 21 in FIG. 1 and has a metallic flange 38 secured thereto for cooperating with a nut 39, in threaded engagement with tube 36, to clamp the tube in position with respect to the housing 37. High band transmission line 28 is capacitively coupled to the bottom of tube 36 by a coaxial capacitor including the dielectric cylinder 29 between the cylindrical metallic plates represented by the telescoped ends of the shield of line 28 and tube 36 as in the case of the similar coupling to tube 21 in FIG. 1. In this FIG. 2 embodiment, the signal path conductor 17 extension of line 28 includes a plug portion (not shown) of a coaxial connector mechanism including a threaded end part 40 on tube 36 and to which a coaxial whip antenna structure, e.g., 10, can be secured with a cooperating pin portion of the coaxial connector.

Figure 3:
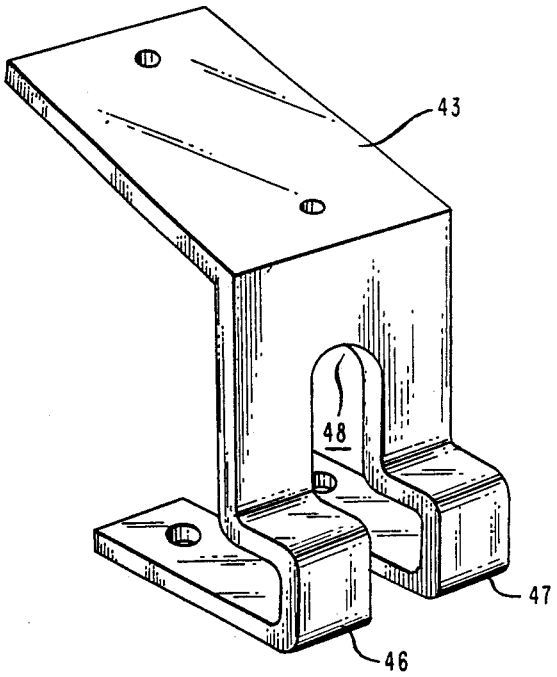
FIG. 3 is a perspective view of a mounting bracket utilized in FIG. 2.

A central signal path conductor of low band transmission line 31 is advantageously connected to a central conductor of the stub filter 32, and that common connection is further connected to tube 36, the high band feed line signal return path, between flange 38 and the housing 37 top wall. Shields of line 31 and stub filter 32 are connected together and further connected to vehicle ground at a stud 41 which cooperates with a nut 42 to hold the housing 37 to a bracket 43. That bracket is illustrated in perspective view in FIG. 3 and is configured to include two arms 46 and 47 defining an aperture 48 between them. The arms are bent to accommodate engagement with an edge of the trunk lid 33 and its edge weather seal 49. Once positioned, the bracket is held in place by set screws 50 (only one of which appears in FIG. 2) in arms 46 and 47. Aperture 48 accommodates passage of transmission lines 28 and 31 around an edge of the lid 33 for connection to the respective high band and low band signal processing equipments with a minimum exposure to damage when the trunk lid is opened and closed.

FIG. 4 is a perspective view of a modified embodiment for use with a power operated retractable antenna assembly. That assembly includes a housing 51 for a motor driven drum around which a coaxial cable 56 portion of the high band transmission line 28 is passed and extended to telescopically extendable antenna mast sections of a multiband antenna as shown for example in U.S. Pat. No. 4,658,260 issued to R. E. Myer, on Apr. 14, 1987 entitled "Multiband Antenna," and assigned to the same assignee as the present application. When retracted, the sections are contained in a cylindrical tube, or casing, 52 which is clamped under a vehicle body panel (not shown) through which the sections pass when raised. The previously described functions of coupler 16 are distributed in the housing 51 and casing 52 as will be described.

Figure 5:
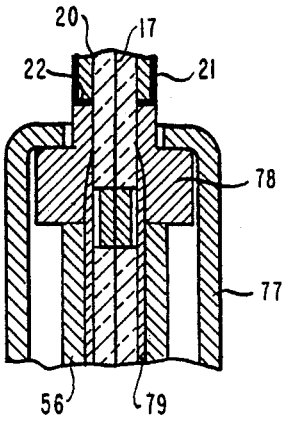
FIG. 5 is an enlarged cross sectional view of a portion of an antenna useful in connection with the embodiment of FIG. 4.

When extended, the top of each section mechanically engages a stop member on the lower end of a section immediately above it, if any, both to provide electrical continuity for coupling intercepted signals to the low band transmission line and mechanically to limit extension prior to disengagement. In the aforementioned Myer applications, the stop member between the high band section and the next lower section of the antenna was made of insulating material. However, in some applications it is useful to take advantage of the high band feed line ground return conductor as part of the low band antenna receiving element, e.g., as is done in the FIG. 1 whip antenna. To that end, a conductive stop member is employed as shown in FIG. 5, which is an enlarged cross sectional view of the region of antenna 10 between the top two sections thereof for the embodiment of FIG. 4. The second section 77 down from the top is a conductive tube that includes the usual inwardly turned upper tip portion for engaging a conductive stop member 78 that is secured at its top to the ring 22. The coaxial cable 56 has its outer conductor 79 electrically connected to the lower end of tube 20 and its center conductor connected as an extension of conductor 17. The desired ground return path for high band signals includes tube 20 and conductor 79. The desired signal flow path for received low band signals includes tube 20, stop 78, tube 77 and any additional lower tubes, or sections of the overall antenna. Separation of those paths is achieved by use of coupler 16 functions including a blocking capacitor and a stub filter.

In FIG. 4, the high band transmission line 28 includes one part 53 of a coaxial connector to facilitate installation. The line 28 also includes a coaxial capacitor coupling (not specifically shown but of the type illustrated in FIG. 1) in series in its shield. That capacitor is formed by telescopic engagement of shields as schematically represented by the enlarged transmission line portion, between the ends of coaxial cable 56, and the line 28 adjacent to a point of entry of the cable 56 into a drum-enclosing portion of housing 51.

As shown in the enlarged view of FIG. 10 indicated by circle 100, the low band transmission line 31 is mechanically terminated in a mounting device 57 secured to casing 52 at an opening in the wall thereof which allows the center conductor of line 31 to pass through the hole to one part 58 of a connector for mating with a conductive pin 59 welded to the side of a tube 60 that is the lowest one of the plural telescopic sections, including section 77, and corresponds to the lower portion of tube 21 in coupler 16 of FIG. 1. Thus, the center conductor of line 31 is connected through pin 59, tube 60 and intervening telescoping sections to section 77, stop 78 and ring 22 to the high band ground return shield 20. The shield of the line 31 is electrically connected through the device 57 and its mounting screws to the casing 52 and from there to the body panel (not shown) of the vehicle to establish a vehicle ground connection. Similarly, the stub filter 32 is advantageously located within casing 52 between the wall of that casing and the tube 60 so that on installation it can be slipped into place through the same opening mentioned above in casing 52. The center conductor of the stub filter 32 is connected to the pin 59, e.g., by a spring clip (not shown); and its shield is stripped away and passed back through the opening in casing 52 and clamped under the device 57 at a mounting screw therefor to make the vehicle ground connection. The point of connection of pin 59 to tube 60 is electrically adjacent to the stub connection to the low band ground return path.

Figure 6:
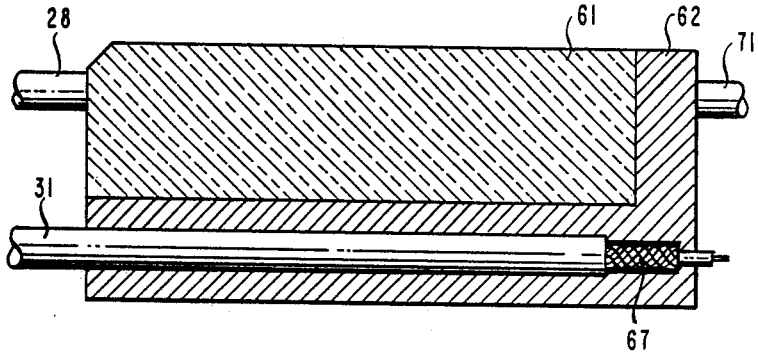
FIGS. 6 and 7 are opposite-side views of a micro-strip transmission line embodiment of the coupler in accordance with the invention.
Figure 7:
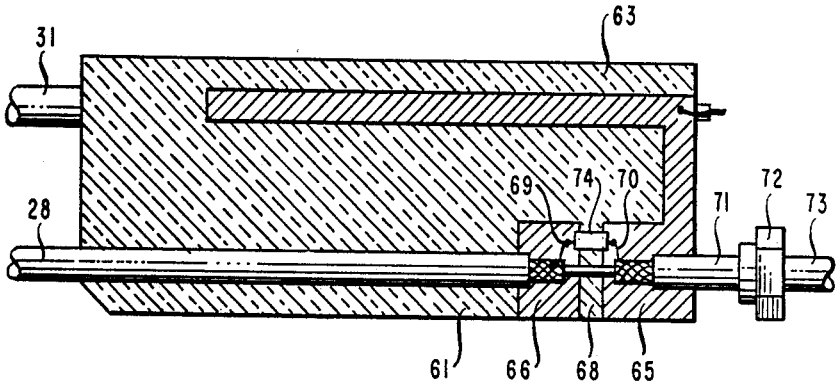

FIGS. 6 and 7 depict a printed circuit embodiment, using micro-strip technology, of the multiband feedline coupler 16 herein considered. A nonconducting, e.g., epoxy-glass substrate 61 of generally rectangular configuration is shown in bottom view in FIG. 6, that side of the substrate here being generally called the ground plane side, and in top view in FIG. 7, that side of the substrate being generally called the signal path side. Deposited on the ground plane side in FIG. 6 is a conductive metallization 62 of, e.g., copper in the shape of the letter L lying on its back, as illustrated. That is, the letter L is rotated counterclockwise in the plane of substrate 61, 90 degrees from its normal upright position. Deposited on the signal plane side of substrate 61 in FIG. 7 is a similar conductive metallization in a pattern resembling the letter J, also rotated counterclockwise 90 degrees (90°) from its normal upright position, with a rectangular metallization, or dot, 66 to the left of the tip of the short end 65, or hook, on the J. It will be appreciated that, as illustrated, the back portion of the J overlies a strip along the center of the right-hand three-quarters of the length of the back of the L; and the bottom portion of the J overlies a strip along the right-hand side of the bottom portion of the L and about half the width of that portion.

Low band coaxial transmission line 31 overlies the back portion of the L in FIG. 6, and at the right-hand end thereof the usual protective jacket on the line is stripped away to expose a length 67 of the shield. That shield length is connected, e.g., by solder beads along each side thereof, to the metallization 62. In a further short length of the line 31, at least to the edge of the substrate 61, both the jacket and the shield are stripped away exposing the dielectric spacing material. A portion of that material at the tip of the line 31 is also stripped away to allow the tip of the central conductor to be wrapped around the edge of the substrate 61 and soldered to the upper right corner, as illustrated in FIG. 7, of the J. That arrangement of the low band line 31 on the substrate 61 causes the back of the L pattern and overlying part of the J pattern to comprise the quarter-wave stub filter in the high band and corresponding to the stub filter 32 in FIG. 1. That is, the indicated parts of the ground plane side metallization 62 and the signal path side metallization 63 correspond to the ground return outer conductor and signal path inner conductor, respectively, of the stub filter 32.

In FIG. 7, the high band coaxial transmission line 28 extends along the signal path side of the substrate 61 to and beyond the dot metallization 66 and the end portion 65 of the J pattern. The protective jacket of the line 28 is stripped away in a portion of the length overlaying adjacent edges of the dot 66, the end portion 65, and an unmetallized region 68 of substrate between them. The shield is stripped away in the portion of the line overlying the region 68 and severed and the shield ends 69 and 70, thereby formed are folded up and soldered to the metallization dot 66 and end portion 65, respectively. A "chip" type capacitor 74 is also connected between 65 and 66. In this way, the adjacent spaced metallizations 65 and 66 and the chip capacitor become the blocking capacitor in series in the ground return path of the high band transmission line 28. The capacitor is electrically at a point in that path which does not interfere with low band signal flow between the shield of a portion 71 of the transmission line, that extends from the antenna as will be described, and the low band transmission line 31 on the opposite side of the substrate 61. The transmission line portion 71 is advantageously provided with a coaxial connector 72 for establishing electrical continuity between central signal path conductors and ground return path shield conductors of the portion 71 and a coaxial transmission line section 73 which extends through a vehicle body panel (not shown) to the antenna per se in a manner similar to that illustrated in connection with FIG. 1. The substrate assembly illustrated is easily encapsulated with the ends of lines 28 and 31 in potting compound to facilitate installation of the associated antenna and radio equipment into a vehicle in the field or in a factory.

It will be appreciated by those skilled in the art that, although the invention has been illustratively described in connection with a coaxial antenna mast with a center-fed high band antenna section, the invention is likewise applicable to other types of antenna assemblies. For example, end-fed rod-type antenna structures are known which can serve both high band and low band functions, usually with appropriate phasing and/or loading coils; and such structures can be stub matched to a common coaxial cable feed line section such as the section 73 in FIG. 7 herein.

Although the present invention has been described in connection with particular embodiments thereof, it is to be understood that additional applications, embodiments, and modifications which will be obvious to those skilled in the art are included within the spirit and scope of the invention.

What is claimed is:

1. A multiband antenna feedline coupling arrangement comprising:

a first transmission line segment having first and second conductors for providing energy transmission for a plurality of bands including a low band signal and a high band signal, said high band signal appearing on the first and second conductors and the low band signal appearing on said second conductor, a second transmission line segment for providing energy transmission for the high band signal having a signal path and a ground return path, the signal path of the second transmission line segment being connected to the first conductor of the first transmission line segment, a capacitor connected in series between the second conductor of the first transmission line segment and the ground return path of said second transmission line segment for presenting a much lower impedance to the frequencies of the high band signal than to the frequencies of the low band signal, a third transmission line segment having a signal path and a ground return path for providing energy transmission for the frequencies of the low band signal including frequencies lower than frequencies in the high band signal, the third transmission line segment having a signal path and a ground return path and presenting a much lower impedance to frequencies of the low band signal than is presented by said capacitor, and means for connecting the third transmission line segment signal path to the second conductor of the first transmission line segment.

2. The multiband antenna coupling arrangement in accordance with claim 1 in which said third transmission line segment further comprises an open circuited quarter-wave stub at a frequency approximately in the center of said high band coupled between the signal path and ground return path of the third transmission line segment for shunting high band signals across said third transmission line segment.

3. The multiband antenna coupling arrangement in accordance with claim 1 in which the first transmission line segment comprises a coaxial transmission line segment having a center conductor as its first conductor and a spaced coaxial conductive shield as its second conductor;

the second transmission line segment comprising a coaxial transmission line segment having a center conductor as the signal path thereof and a spaced coaxial conductive shield as the ground return path thereof, and the capacitor connected in series between the second conductor of the first transmission line segment and the ground return path of said second transmission line segment comprises a coaxial capacitor formed between the spaced coaxial conductive shield of the first coaxial transmission line segment and the spaced coaxial conductive shield of the second coaxial transmission line segment by telescopically overlapping electrically adjacent end portions of said first and second coaxial transmission line segments and disposing insulating material coaxially between said overlapping end portions.

4. The multiband antenna coupling arrangement in accordance with claim 3 in which means are secured to, and electrically insulated from, said first transmission line segment for supporting said coupling arrangement on a conductive ground plane with said capacitor electrically below said ground plane and a portion of said first transmission line segment extending above said ground plane, the latter portion comprising both part of a coaxial feed line for a high band portion of the multiband antenna and a part of an energy intercepting element for a low band portion of the multiband antenna.

5. The multiband antenna feedline coupling arrangement in accordance with claim 1 in which the first transmission line segment is a coaxial cable segment having a center conductor as its first conductor and an outer shield as its second conductor, each of the second and third transmission line segments is a coaxial cable segment having a center conductor as its signal path and an outer shield as its ground return path, and said capacitor comprises a coaxial capacitor connected in series between the outer shields of the first and second transmission line segments.

6. The multiband antenna feedline coupling arrangement in accordance with claim 1 in which said capacitor is connected between first and second spaced metallization regions on a dielectric substrate, the first spaced metallization region being connected to the second conductor of the first transmission line segment and the second spaced metallization region being connected to the ground return path of said second transmission line segment, and the connecting means between the second conductor of the first transmission line segment and the signal path of the transmission line segment is a printed circuit transmission line on said substrate.

7. The multiband antenna feedline coupling arrangement in accordance with claim 6 in which said quarter wave stub is a printed circuit transmission line on said substrate.

* * * * *